US006696678B2

(12) United States Patent
Hudson et al.

(10) Patent No.: US 6,696,678 B2
(45) Date of Patent: Feb. 24, 2004

(54) OVER TURNTABLE APPARATUS

(75) Inventors: Jeffrey R. Hudson, Louisville, KY (US); Charles A. Ulmer, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/992,919

(22) Filed: Nov. 14, 2001

(65) Prior Publication Data

US 2003/0089708 A1 May 15, 2003

(51) Int. Cl.[7] ..... H05B 6/78

(52) U.S. Cl. ..... 219/754; 219/756; 219/739; 219/762; 126/338

(58) Field of Search ..... 219/754, 755, 219/756, 762, 739, 763, 385, 392, 391; 126/338, 337 R; 99/443 R; 312/236

(56) References Cited

U.S. PATENT DOCUMENTS

| | | | | |
|---|---|---|---|---|
| 3,440,385 A | * | 4/1969 | Smith | 219/754 |
| 3,961,152 A | | 6/1976 | Staats | |
| 4,107,502 A | * | 8/1978 | Tanaka et al. | 219/754 |
| 4,136,271 A | * | 1/1979 | Tanaka et al. | 219/754 |
| 4,239,009 A | | 12/1980 | Cunningham | |
| 4,456,805 A | | 6/1984 | Jorgensen et al. | |
| 4,501,945 A | | 2/1985 | Arabori et al. | |
| 5,097,106 A | * | 3/1992 | Arai et al. | 219/763 |
| 5,345,068 A | | 9/1994 | Hatano et al. | |
| 5,674,421 A | * | 10/1997 | Beaver, II et al. | 219/385 |
| 5,747,781 A | | 5/1998 | Kim et al. | |
| 6,137,097 A | | 10/2000 | Smith et al. | |
| 6,252,214 B1 | * | 6/2001 | Han et al. | 219/754 |

FOREIGN PATENT DOCUMENTS

| | | | | |
|---|---|---|---|---|
| FR | 2 627 259 | * | 8/1989 | 219/756 |
| JP | 1-184332 | * | 7/1989 | 219/756 |
| KR | 2001-077299 | * | 8/2001 | |

* cited by examiner

*Primary Examiner*—Philip H. Leung
(74) *Attorney, Agent, or Firm*—H. Neil Houser, Esq.; Armstrong Teasdale, LLP

(57) ABSTRACT

In one aspect, a microwave oven comprising an outer case, a door secured to the outer case, and a turntable supported in the case but extending beyond a case front face is described. In an example embodiment, the outer case houses a portion of a cooking cavity, and the cooking cavity is partially defined by a bottom inner wall, a top inner wall, and side inner walls of the case. The door is secured to the case, and the door comprises an inner wall comprising a recessed portion. The oven further includes an RF energy source for supplying RF energy to the cooking cavity, a controller coupled to the RF energy source for controlling supply of RF energy to the cooking cavity, and a user interface coupled to the controller.

17 Claims, 3 Drawing Sheets

OVER TURNTABLE APPARATUS

BACKGROUND OF THE INVENTION

This invention relates generally to ovens and, more particularly, to turntable arrangements.

An over the range type oven typically includes an outer case and a door securely attached to the outer case. A cooking cavity is defined by inner side walls, an inner top wall, and an inner bottom wall of the case. Prior to cooking, the door is closed so that a door inner surface is adjacent to and forms a seal with a front face surface of the case.

A turntable typically is positioned within a recess in the case inner bottom wall. Specifically, the turntable typically has a circular shape and is supported on a carrier that includes plastic wheels. The carrier typically is positioned within a recessed portion in the inner bottom wall so that an upper surface of the turntable is co-planer with a non-recessed portion of the bottom wall, e.g., to facilitate preventing spills.

Since the turntable is located in the bottom wall recessed portion, removing the turntable sometimes can be difficult. In addition, if food crumbs or debris are located on the turntable, the crumbs or debris may fall in the recessed portion when removing the turntable since the turntable often is tilted by the user when removing the turntable. The crumbs and debris then should be cleaned from the recessed portion.

A useable volume of the cooking cavity generally is defined by a cylindrical volume having a same diameter and concentric with the turntable, and extending from the turntable to the top wall of cooking cavity. The useable volume generally refers to a space within the cooking cavity in which food can be positioned for cooking.

With known microwave ovens, the turntable is completely positioned within a perimeter of the case and therefore, the useable volume of such ovens is limited by the size of the case. That is, the useable volume does not extend beyond the case perimeter, e.g., the front face surface of the case. Increasing the useable volume would, however, facilitate cooking larger food portions.

BRIEF SUMMARY OF THE INVENTION

In one aspect, a microwave oven comprising an outer case, a door secured to the outer case, and a turntable supported in the case but extending beyond a case front face is provided. More particularly, the outer case houses a portion of a cooking cavity, and the cooking cavity is partially defined by a bottom inner wall, a top inner wall, and side inner walls of the case. The door is secured to the case, and the door comprises an inner wall comprising a recessed portion. The oven further includes an RF energy source for supplying RF energy to the cooking cavity, a controller coupled to the RF energy source for controlling supply of RF energy to the cooking cavity, and a user interface coupled to the controller.

In another aspect, an oven housing comprising an outer case comprising a front face and housing a portion of a cooking cavity is provided. The oven housing comprises a useable volume that extends beyond a perimeter defined by the outer case front face.

In yet another aspect, an oven assembly comprising an outer case, a turntable supported and at least partially positioned within the outer case, and a cooking cavity at least partially defined by a bottom inner wall within the outer case, is provided. The bottom wall comprises at least one raised wall, and an upper surface of the raised wall extends to a height sufficient to facilitate supporting an item at least partially positioned on the turntable.

DETAILED DESCRIPTION OF THE INVENTION

A microwave oven is described below in detail. Although extending the useable volume of a cooking cavity beyond an oven case is described below in the context of a microwave oven, the cooking cavity useable volume can be extended in other type ovens such as in ovens that include radiant cooking elements and ovens that include a combination of energy sources, such as radiant and microwave cooking elements. The turntable arrangement described herein, therefore, is not limited to practice with microwave ovens and can be used in other oven types. Such ovens are known and commercially available, for example, from the GE Appliances business of General Electric Company, Louisville, Ky.

In addition, although the microwave oven described below is an over the range type oven, other types of ovens can be utilized. For example, rather than being an over the range type oven, the oven could be a countertop type oven.

Figure 1:
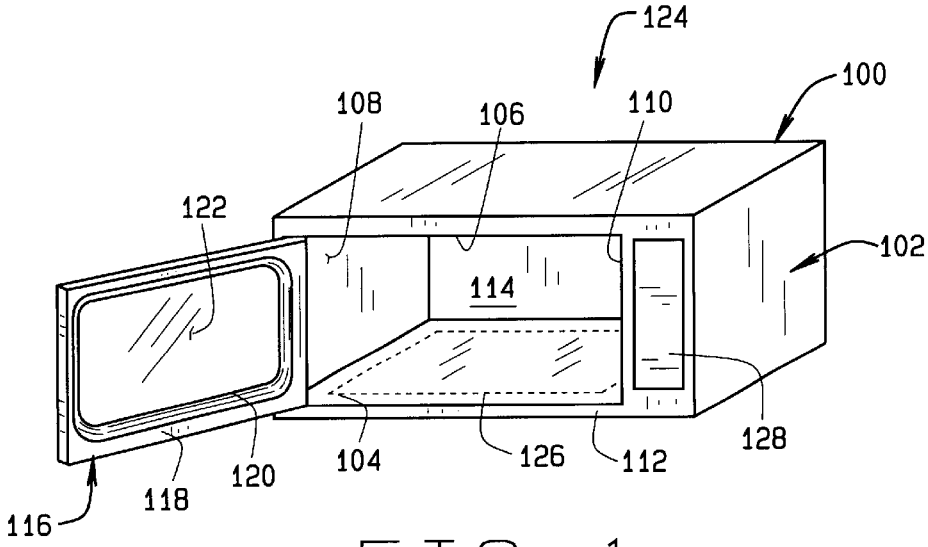
FIG. 1 is a perspective view of a microwave oven.

FIG. 1 is a perspective view of an over the range type oven 100. Oven 100 includes an outer case 102. Case 102 includes an inner bottom wall 104, an inner top wall 106, and inner side walls 108 and 110. In addition, case 102 includes a front face surface 112, sometimes referred to herein as a front face. Case 102 houses a portion of a cooking cavity 114. Cooking cavity 114 is partially defined by bottom, top, and side walls 104, 106, 108, and 110.

A door 116 is secured to case 102. Door 116 includes an inner wall 118, and inner wall 118 includes a recessed portion 120. Inner wall 118, including recessed portion 120, defines a portion of cooking cavity 114 when door 116 is closed. Door 116 further includes an injection molded handle (not shown). A window 122 is provided for visualizing food in oven cooking cavity 114. Door 116 and case 102 sometimes are collectively referred to herein as a housing 124.

A turntable (not shown in FIG. 1) is supported within case 102 in an area generally identified by dotted line 126 in FIG. 1. As further explained below in more detail, a portion of the turntable extends beyond case front face 112. By extending the turntable beyond the case front face 112, the useable volume of oven 100 is increased as compared to a conventional oven with a same size case.

Oven 100 further includes an energy source (not shown in FIG. 1), e.g., an RF energy source such as a magnetron for supplying RF energy to cooking cavity. A controller (not shown in FIG. 1) is coupled to RF energy source for controlling supply of RF energy to cooking cavity 114. A user interface 128 is coupled to the controller. Particularly, a key pad (not shown not shown in FIG. 1) is provided at an exterior of case 102, and key pad includes a plurality of keys as is known in the art for a user to make cooking control selections.

Figure 2:
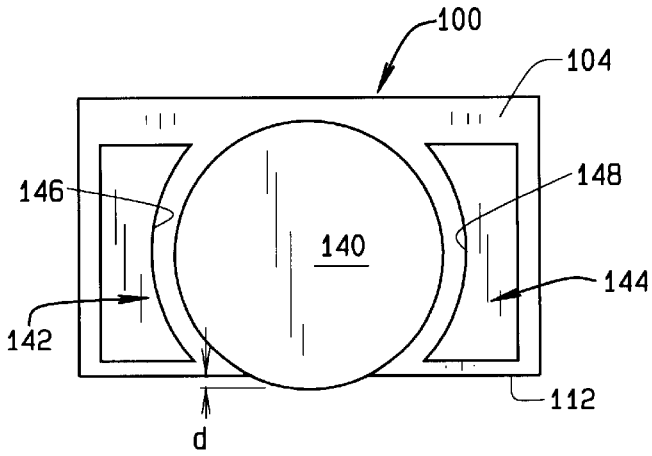
FIG. 2 is a top view of a portion of a cooking chamber of a microwave oven.

FIG. 2 is a top view of a portion of cooking cavity 114 of oven 100. As shown in FIG. 2, oven 100 includes a turntable 140 that extends beyond front face 112. The portion of turntable 140 that extends beyond front face 112 is located within recessed portion 120 of door 116 when door 116 (FIG. 1) is in a closed position. By extending turntable 140 beyond front face 112 and into door recessed portion 120, the useable volume of oven 100 is increased as compared to the useable volume achieved with a turntable that does not extend beyond front face 112.

In one specific embodiment, turntable 140 has a diameter of 14.2 inches. A distance d which turntable 140 extends beyond front face 112 is 0.5 inches. Of course, the specific dimensions of turntable 140 and the extent to which turntable 140 extends beyond front face 112 can vary from oven type to oven type and from model to model.

In addition, bottom wall 104 includes a first raised wall 142 and a second raised wall 144. First and second raised walls 142 and 144 are located at opposing ends of bottom wall 104. Each raised wall 142 and 144 has a semi-circular inner surface 146 and 148 coextensive with a portion of turntable 140.

Figure 3:
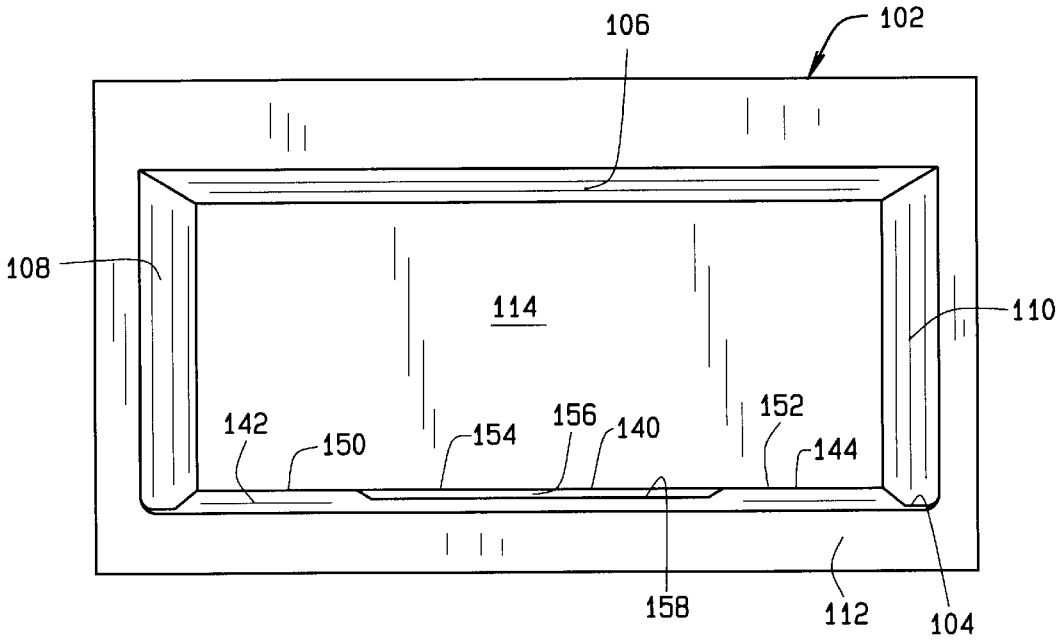
FIG. 3 is side view of a portion of the microwave oven cooking chamber illustrated in FIG. 2.
Figure 4:
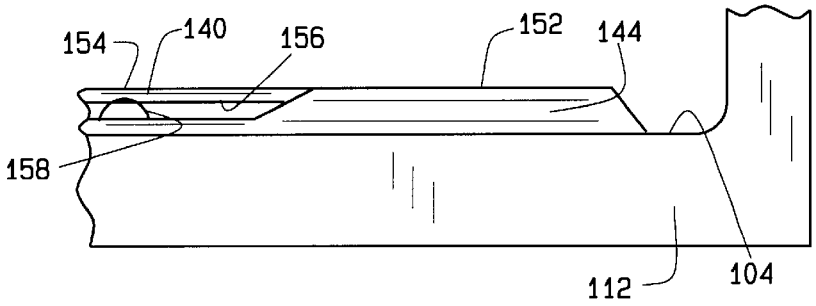
FIG. 4 is an enlarged view of a portion of the cooking chamber shown in FIG. 3.

FIG. 3 is side view of a portion of oven 100 illustrated in FIG. 2, and FIG. 4 is an enlarged view of a portion of cooking cavity 114 shown in FIG. 3. As shown in FIGS. 3 and 4, each raised wall 142 and 144 includes an upper surface 150 and 152, and upper surfaces 150 and 152 of raised walls 142 and 144 extend to a height sufficient to facilitate supporting an item at least partially positioned on turntable 140. More particularly, and in one embodiment, an upper surface 154 of turntable 140 is coplanar with upper surfaces 150 and 152 of raised walls 140 and 144.

As also shown in FIGS. 3 and 4, turntable 140 is supported in case 102. Particularly, turntable 140 rests on a carrier 156 that is supported in case 102 on rollers 158. Carrier 156 is driven to rotate by a motor (not shown), as is known in the art, and turntable 140 rotates with carrier 156.

Turntable 140 is, for example, plastic and formed using a plastic molding process, as is known in the art. In addition, walls 104, 106, 108 and 110 of case 102 and wall 118 of door 116 are plastic and also are formed using a plastic molding process, as is known in the art.

Figure 5:
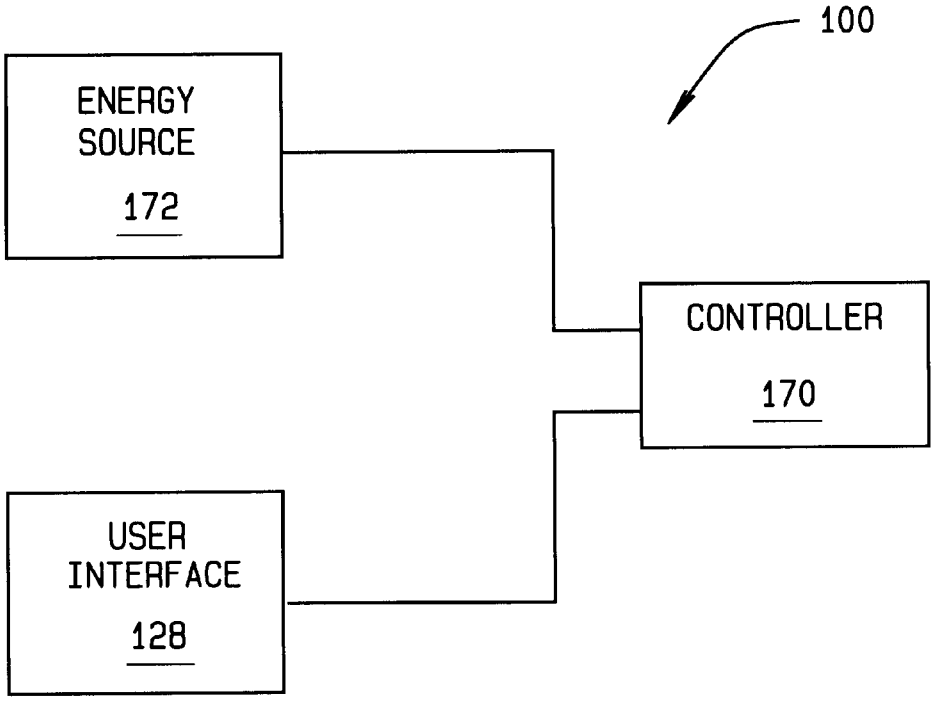
FIG. 5 is a block diagram of certain components of an oven.

FIG. 5 is a block diagram of certain components of oven 100. Specifically, oven 100 includes a controller 170 coupled to an energy source 172 and user interface 128. In an example embodiment, energy source 172 is an RF energy (e.g., a magnetron) source for supplying RF energy to the oven cooking cavity. Controller 170 controls operation of energy source 172 so that energy is supplied to the cooking cavity in accordance with user selections at user interface 128. In an example embodiment, interface 128 includes a keypad and display, as is known in the art. Energy source 172 is not limited to being an RF energy source, but also could be other energy sources such as a radiant energy source, a thermal/convection energy source, and combinations thereof.

By extending the turntable beyond the front face of the case, the useable volume of the cooking cavity is increased as compared to ovens in which the useable volume is fully contained within the case. As a result of increasing the useable volume, larger food portions can be cooked in the oven at one time. In addition, extending the turntable beyond the case front face facilitates easy removable of the turntable for cleaning. Rather than having to attempt to remove the turntable from a recess within the bottom wall as with at least some known microwave ovens, and when the door is in an open position, the user can easily and readily grip the portion of the turntable that extends beyond the front face and simply lift the turntable off the carrier.

While the invention has been described in terms of various specific embodiments, those skilled in the art will recognize that the invention can be practiced with modification within the spirit and scope of the claims.

What is claimed is:

1. A microwave oven, comprising:

an outer case comprising a front face and housing a portion of a cooking cavity, said cooking cavity partially defined by a bottom inner wall, a top inner wall, and side inner walls of said case, said bottom inner wall comprising a first raised wall and a second raised wall, said first and second raised walls located at opposing ends of said bottom wall;

a door secured to said case, said door comprising a substantially planar outer surface and an inner wall, said door inner wall comprising a recessed portion;

a turntable supported in said case, a portion of said turntable extending beyond said case front face, each of said first raised wall and second raised wall having a semi-circular inner surface coextensive with a portion of said turntable;

an RF energy source for supplying RE energy to said cooking cavity;

a controller coupled to said RF energy source for controlling supply of RF energy to said cooking cavity; and a user interface coupled to said controller.

2. A microwave oven according to claim 1 wherein an upper surface of at least one of said first and second raised walls extends to a height sufficient to facilitate supporting an item at least partially positioned on said turntable.

3. A microwave oven according to claim 2 wherein said upper surface of said at least one raised wall is coplanar with a top surface of said turntable.

4. A microwave oven according to claim 1 wherein each of said raised walls comprises an upper surface, said upper surfaces of said raised walls extending to a height sufficient to facilitate supporting an item at least partially positioned on said turntable.

5. An oven housing comprising:

an outer case comprising a bottom inner wall and a front face, said bottom inner wall comprising a first raised wall and a second raised wall, each of said first raised wall and said second raised wall having a semi-circular inner surface extending opposite one another; and a turntable supported in said case, a portion of said turntable extending beyond said case front face, said turntable having a top surface substantially coplanar with an upper surface of said first and second raised walls.

6. An oven housing according to claim 5 wherein said cooking cavity is partially defined by said bottom inner wall, a top inner wall, and side inner walls of said case.

7. An oven housing according to claim 6 further comprising a door secured to said case, said door comprising an inner wall, said inner wall comprising a recessed portion defining a portion of said cooking cavity when said door is closed.

8. An oven housing according to claim 5 wherein said first and second raised walls are located at opposing ends of said bottom wall, each of said semi-circular inner surfaces coextensive with a portion of said turntable.

9. An oven housing according to claim 8 wherein each of said raised walls comprises an upper surface, said upper surfaces of said raised walls extending to a height sufficient to facilitate supporting an item at least partially positioned on said turntable.

10. An oven housing according to claim 5 further comprising a turntable supported in said case so that a portion of said turntable extends beyond said case front face.

11. An oven assembly comprising:

an outer case;

a turntable supported in said outer case, a portion of said turntable extending beyond a front face of said outer case; and a cooking cavity at least partially defined by a bottom inner wall within said outer case, said bottom wall comprising a first raised wall and a second raised wall extending from opposing ends thereof, each of said raised walls having an inner surface coextensive with a portion of said turntable, an upper surface of said raised wall extending to a height sufficient to facilitate supporting an item at least partially positioned on said turntable.

12. An assembly according to claim 11 wherein said upper surface of said raised wall is coplanar with a top surface of said turntable.

13. An assembly according to claim 11, each of said raised walls having a semi-circular inner surface coextensive with a portion of said turntable.

14. An assembly according to claim 13 wherein each of said raised walls comprises an upper surface, said upper surfaces of said raised walls extending to a height sufficient to facilitate supporting an item at least partially positioned on said turntable.

15. An oven, comprising:

an outer case comprising a front face and housing at least a portion of a cooking cavity, said cooking cavity at least partially defined by a bottom inner wall comprising a first raised wall and a second raised wall extending on opposite ends thereof, a top inner wall, and side inner walls of said case;

a door coupled to said case and having an open position and a closed position, said door comprising an inner wall, said door inner wall comprising a substantially planar recessed portion;

a turntable supported in said case between said first raised wall and said second raised wall, a portion of said turntable extending beyond said case front face and into said door recessed portion when said door is in said closed position; and an energy source for supplying energy to said cooking cavity.

16. An oven according to claim 15 wherein said energy source comprises at least one of an RF energy source, a radiant energy source, and a thermal/convection energy source.

17. An oven according to claim 15 wherein said first and second bottom walls comprise an upper surface, said upper surface extending to a height sufficient to facilitate supporting an item at least partially positioned on said turntable.

* * * * *

UNITED STATES PATENT AND TRADEMARK OFFICE

CERTIFICATE OF CORRECTION

PATENT NO. : 6,696,678 B2
DATED : February 24, 2004
INVENTOR(S) : Hudson et al.

It is certified that error appears in the above-identified patent and that said Letters Patent is hereby corrected as shown below:

Title page,
Item [54], Title, delete "OVER" and insert therefor -- OVEN --.

Column 4,
Line 29, after "source for supplying" delete "RE" and insert therefor -- RF --.

Signed and Sealed this

Eighth Day of November, 2005

JON W. DUDAS
*Director of the United States Patent and Trademark Office*